US006003413A

United States Patent [19]

Macor

[11] Patent Number: 6,003,413

[45] Date of Patent: Dec. 21, 1999

[54] COMPACT ERGONOMIC RATCHET WRENCH

[75] Inventor: Richard J. Macor, Greenwich Twsp., Warren County, N.J.

[73] Assignee: Proprietary Technologies, Inc., Asbury, N.J.

[21] Appl. No.: 08/895,069

[22] Filed: Jul. 16, 1997

[51] Int. Cl.[6] ..... B25B 13/46

[52] U.S. Cl. ..... 81/60; 81/489; D8/25

[58] Field of Search ..... 81/60, 61, 62, 81/489, 63, 63.1, 63.2, 177.1; D8/25, DIG. 7, 107, 21, 80, 83, 321, 322; 16/110 R, 116 R, DIG. 12

[56] References Cited

U.S. PATENT DOCUMENTS

| | | | |
|---|---|---|---|
| D. 300,296 | 3/1989 | Krapowicz et al. | D8/25 |
| D. 396,785 | 8/1998 | Macor | D8/25 |
| D. 397,597 | 9/1998 | Davidson et al. | D8/25 |
| 2,288,217 | 6/1942 | Trautman | 81/61 |
| 3,881,376 | 5/1975 | Wright | 81/63 |
| 4,327,611 | 5/1982 | Catanese et al. | D8/21 |
| 4,811,637 | 3/1989 | McCleary | 81/489 |
| 5,595,095 | 1/1997 | Hillinger | 81/60 |

FOREIGN PATENT DOCUMENTS

| | | | |
|---|---|---|---|
| 2139 | of 1909 | United Kingdom | 81/177.1 |

*Primary Examiner*—David A. Scherbel
*Assistant Examiner*—Joni B. Danganan

[57] ABSTRACT

A wrench tool which has a head and connected handle formed as a lever. The head has a ratcheting mechanism and a distinctive shape different than the connected handle. The ratchet type wrench also has a gripping means with dimensions of length greater than width, and width greater than thickness. The gripping means encompasses a substantial portion, if not all of the handle, and at least a small portion of the ratchet head. In some preferred embodiments, the gripping means is formed with a "V" shaped or semi-circle shaped cut-out adapted to accommodate the shape of the ratchet head so that the gripping means does not obstruct the upper or lower surfaces of the ratchet head.

6 Claims, 2 Drawing Sheets

COMPACT ERGONOMIC RATCHET WRENCH

BACKGROUND OF THE INVENTION

1. Field of the Invention

The present invention relates to tools, particularly hand tools and most particularly ratchet type wrenches. Ratchet wrenches are wrenches which have a head with a ratcheting mechanism to expedite the removal and installation of various fasteners. The present invention involves a compact, ergonomic ratchet wrench with a head at one end and a connected handle and lever at the other end. The present invention further involves a gripping means formed to encompass a substantial portion of the ratchet wrench handle and at least a small portion of the ratchet wrench head to improve user comfort and control.

SUMMARY OF THE INVENTION

The present invention involves a wrench tool which has a head and connected handle formed as a lever. The head has a ratcheting mechanism and a distinctive shape different than the connected handle. The present invention further involves a gripping means with dimensions of length greater than width, and width greater than thickness. The gripping means encompasses a substantial portion, if not all of the handle, and at least a small portion of the ratchet head. In some preferred embodiments, the gripping means is formed with a "V" shaped or semi-circle shaped cut-out adapted to accommodate the shape of the ratchet head so that the gripping means does not obstruct the upper or lower surfaces of the ratchet head.

A user will generally experience good leverage but poor speed and control with a ratchet wrench that has a long handle or lever because the user's hand is positioned away from the center axis of wrench rotation. Subsequently, these ratchets have excellent leverage capabilities but poor control. In fact a user will frequently move up upon the ratchet head and mechanism and closer to the center axis of wrench rotation to improve the speed and control of the tool. A user will generally experience poor leverage yet good speed and control with a ratchet wrench having a short handle or lever because the user's hand is positioned closer to the center axis of wrench rotation. An example of such a ratchet wrench would be a "palm ratchet" which has a gripping means that is usually round or triangular in shape and surrounds the ratchet head and mechanism. These ratchets have excellent speed and control but poor leverage without a lever.

Accordingly, it is a primary objective of the present invention to provide a user with the speed and control of a palm type ratchet, without sacrificing the leverage of a standard, ratchet wrench with a handle formed as a lever. This object is accomplished by providing for a ratchet wrench with a handle formed as a lever that allows a user to comfortably move up onto the ratchet head and close to the center axis of wrench rotation.

It is another important objective of the present invention to provide a user with a ratchet wrench that is comfortable and ergonomic, permitting a greater application of force by user, resulting in improved leverage over a standard ratchet wrench of equal length.

It is another objective of the present invention to provide a user with a tool that is compact in size and efficient in design.

BRIEF SUMMARY OF THE DRAWINGS

The present invention as described in this specification will be more fully understood when taken in conjunction with the drawings appended hereto, wherein.

DETAILED DESCRIPTION OF THE DRAWINGS

Figure 1:
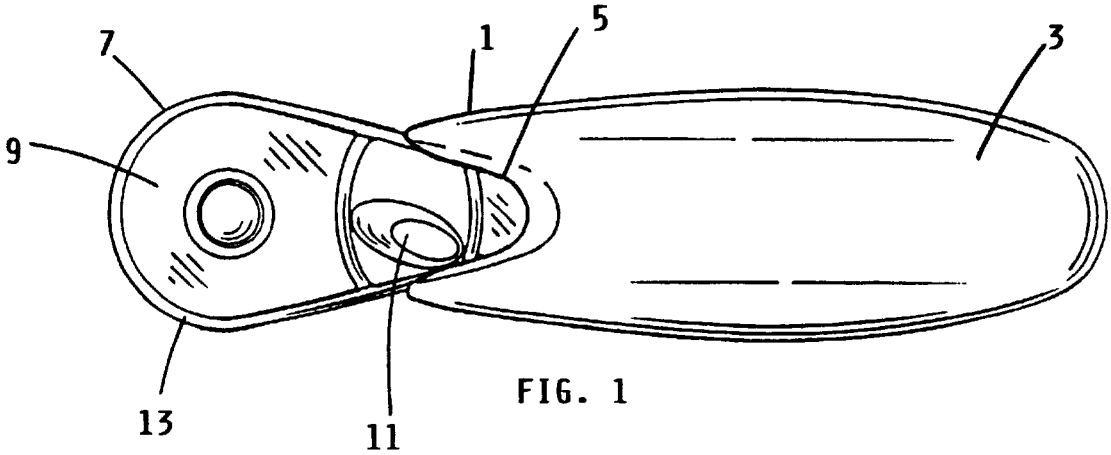
FIG. 1 is a top view of a present invention ratchet wrench.

FIG. 1 shows compact, ergonomic ratchet wrench 1 with gripping means 3 and wrench head 7 containing a ratcheting mechanism (not visible). Ratchet wrench 1 also has a handle lever entirely encompassed by gripping means 3 and therefore not visible in this view. In this view you can see that gripping means 3 has dimensions of length greater than width. Wrench head 7 has upper area 9, side areas 13 and means to control ratcheting direction 11. Note that wrench head 7 has a distinctive teardrop shape and gripping means 3 encompasses a portion of wrench head 7 without obstructing the upper area 9 of wrench head 7. This is accomplished with the "V" shaped cut-out 5, necessary so that grip 3 does not interfere with or obstruct the operation of element 11 which is the means used to control ratcheting direction.

The present invention gripping means 3 encompasses a portion of wrench head 7 to provide for a smooth transition between wrench head and grip. This arrangement allows a user to comfortably move up onto the ratchet head and close to the center axis of wrench rotation for superior comfort and control. In addition, grip 3 which encompasses the wrench handle and lever is comfortable and ergonomic, permitting a greater application of force by user, resulting in improved leverage over a standard ratchet wrench of equal length.

Figure 2:
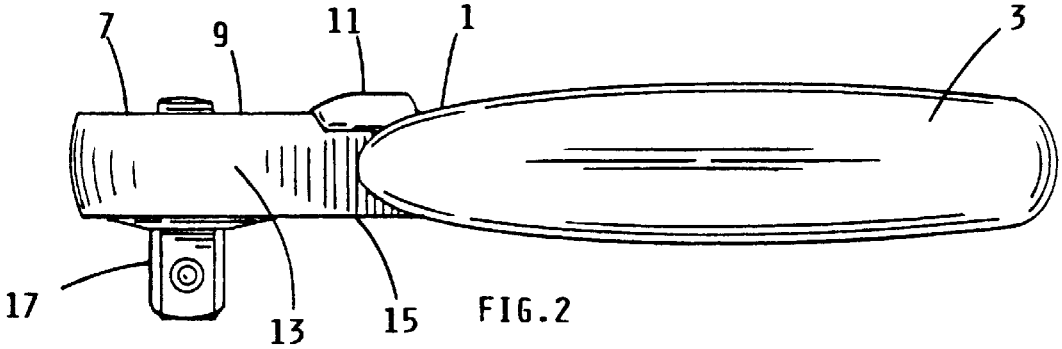
FIG. 2 is a side view of the present invention ratchet wrench shown in FIG. 1.

FIG. 2 shows a side view of the present invention ratchet wrench shown in FIG. 1. In this view, wrench head side areas 13 are more visible and the thickness dimension of gripping means 3 becomes visible. In addition, the lower area 15 of wrench head 7 and the means for attachment with sockets and other tools 17 becomes visible. When viewing both FIGS. 1 and 2 together, you can see that gripping means 3 has dimensions of length greater than width and width greater than thickness. Applicant believes that a grip with these dimensions provides for superior comfort and ergonomics, permitting a greater application of force by user resulting in improved leverage over a standard ratchet wrench of equal length.

Figure 3:
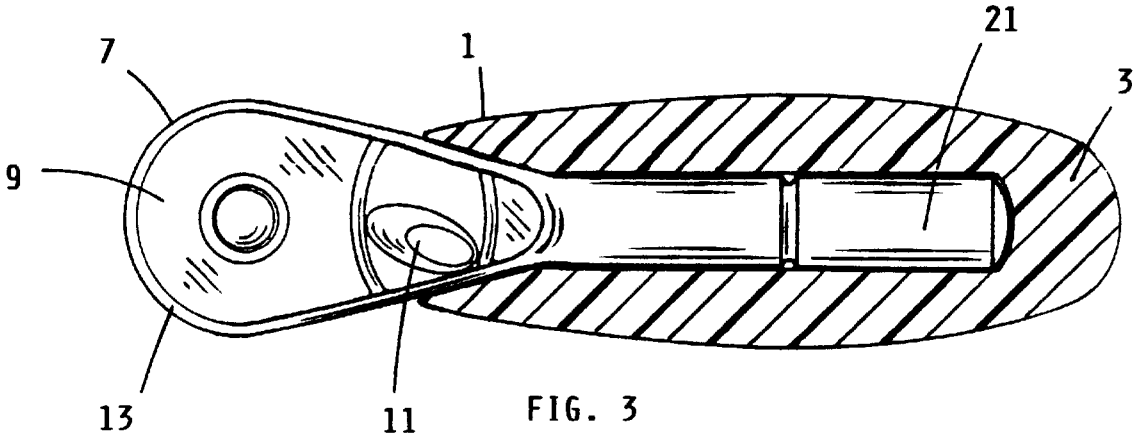
FIG. 3 is a top view of the present invention ratchet wrench shown in FIG. 1 with a cross-section cut of the gripping means.

FIG. 3 shows a top view of the present invention ratchet wrench shown in FIGS. 1 and 2, with a cross-section cut of gripping means 3. In this view, the handle formed as a lever 21 is visible. In addition, you can see that wrench head 7 has a distinctive shape different than the handle formed as a lever 21.

Figure 4:
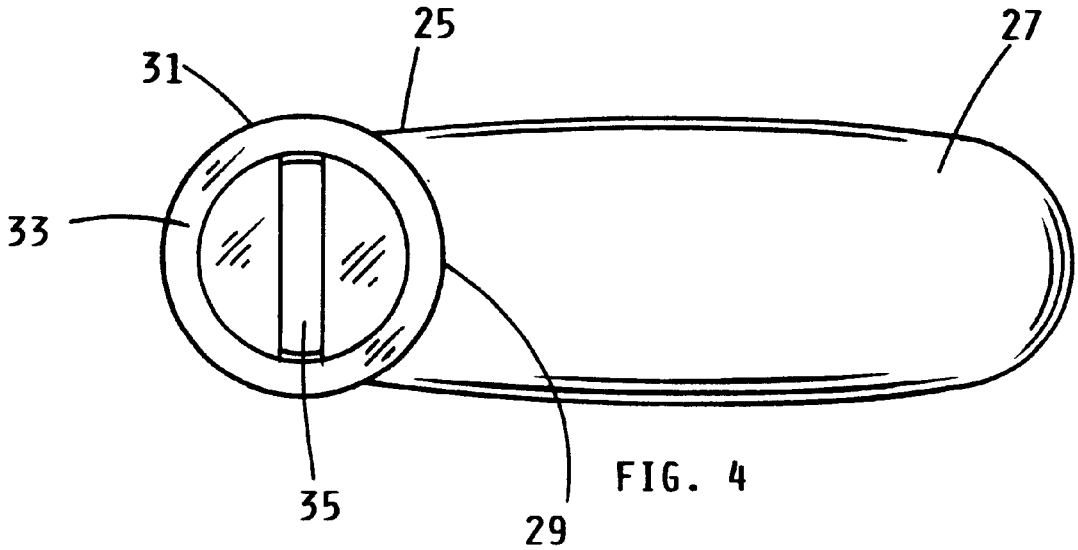
FIG. 4 is a top view of an alternate embodiment of the present invention ratchet wrench; and, FIG. 5 is a side view of the present invention ratchet wrench shown in FIG. 4.

FIG. 4 shows another present invention compact, ergonomic ratchet wrench 25, with gripping means 27 having a semi-circular cut-out 29 adapted for circular shaped wrench head 31 containing a ratcheting mechanism (not visible). Ratchet wrench 25 also has a handle lever entirely encompassed by gripping means 27 and therefore not visible in this view. In this view you can see that gripping means 27 has dimensions of length greater than width. Note that wrench head 31 has a distinctive circular shape and gripping means 27 encompasses a portion of wrench head 31 without obstructing the upper area 33 of wrench head 31. This is accomplished with the semi-circular shaped cut-out 29, and necessary so that grip 27 does not interfere with or obstruct the operation of element 35 which is the means used to control ratcheting direction.

Figure 5:
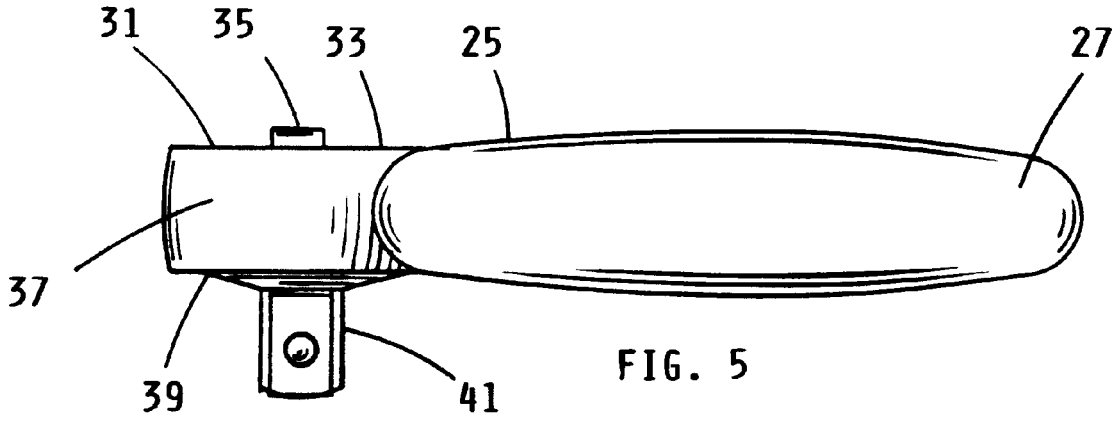

FIG. 5 shows a side view of the present invention ratchet wrench shown in FIG. 4. In this view, wrench head side areas 37 are visible and the thickness dimension of gripping means 27 becomes visible. In addition, the lower area 39 of wrench head 31 and the means for attachment with sockets and other tools 41 becomes visible. When viewing both FIGS. 4 and 5 together, you can see that gripping means 27 has dimensions of length greater than width and width greater than thickness. Applicant believes that a grip with these dimensions provides for superior comfort and ergonomics, permitting a greater application of force by user, resulting in improved leverage over a standard ratchet wrench of equal length.

Upon reading and understanding the specification of the present invention described above, modifications and alterations will become apparent to those skilled in the art. It is intended that all such modifications and alterations be included insofar as they come within the scope of the patent as claimed or the equivalence thereof.

Having thus described the invention, what is claimed as new and desired to be secured by Letters Patent:

1. A wrench tool comprising:

a wrench head positioned at one end of said wrench tool and containing a ratcheting mechanism, said wrench head having a tear drop shape and being connected to a handle formed as a lever; and, a gripping means having dimensions of length greater than width and width greater than thickness, said gripping means further being formed to encompass a substantial portion of said handle and a portion of said wrench head whereas, said gripping means has a "V" shaped cut-out where said gripping means encompasses said portion of said wrench head.

2. A wrench tool comprising:

a wrench head positioned at one end of said wrench tool and containing a ratcheting mechanism, said wrench head having a circular shape and being connected to a handle formed as a lever; and, a gripping means having dimensions of length greater than width and width greater than thickness, said gripping means further being formed to encompass a substantial portion of said handle and a portion of said wrench head whereas, said gripping means has a semi-circular shaped cut-out where said gripping means encompasses said portion of said wrench head.

3. A wrench tool comprising:

a wrench head positioned at one end of said wrench tool and containing a ratcheting mechanism, said wrench head having a tear drop shape with an upper area, a lower area and being connected to a handle formed as a lever; and, a gripping means having dimensions of length greater than width and width greater than thickness, said gripping means being formed to encompass a substantial portion of said handle and a portion of said wrench head whereas, said gripping means has a "V" shaped cut-out where said gripping means encompasses said portion of said wrench head, and, said gripping means does not obstruct the upper area of said wrench head.

4. A wrench tool of claim 3, wherein said gripping means does not obstruct the lower area of said wrench head.

5. A wrench tool comprising:

a wrench head positioned at one end of said wrench tool and containing a ratcheting mechanism, said wrench head having a circular shape with an upper area, a lower area and being connected to a handle formed as a lever; and, a gripping means having dimensions of length greater than width and width greater than thickness, said gripping means being formed to encompass a substantial portion of said handle and a portion of said wrench head whereas, said gripping means has a circular shaped cut-out where said gripping means encompasses said portion of said wrench head, and, said gripping means does not obstruct the upper area of said wrench head.

6. A wrench tool of claim 5, wherein said gripping means does not obstruct the lower area of said wrench.

* * * * *